US008985882B2

(12) United States Patent
Rosato et al.

(10) Patent No.: US 8,985,882 B2
(45) Date of Patent: Mar. 24, 2015

(54) TWO PIECE TWIST ACTION RETRACTABLE WRITING INSTRUMENT

(75) Inventors: Steven Rosato, Palm Harbor, FL (US); Christopher K. Nelson, Dunedin, FL (US); Stephen Wegzyn, Lutz, FL (US); Derek Diaz, Lutz, FL (US)

(73) Assignee: BIC Corporation, Shelton, CT (US)

( * ) Notice: Subject to any disclaimer, the term of this patent is extended or adjusted under 35 U.S.C. 154(b) by 410 days.

(21) Appl. No.: 13/430,640

(22) Filed: Mar. 26, 2012

(65) Prior Publication Data

US 2013/0129401 A1 May 23, 2013

Related U.S. Application Data

(60) Provisional application No. 61/561,481, filed on Nov. 18, 2011.

(51) Int. Cl.

| | |
|---|---|
| ***B43K 5/16*** | (2006.01) |
| ***B43K 24/02*** | (2006.01) |
| ***B43K 8/24*** | (2006.01) |
| ***B43K 7/12*** | (2006.01) |
| ***B43K 23/12*** | (2006.01) |
| ***B43K 24/06*** | (2006.01) |

(52) U.S. Cl.

CPC ... *B43K 8/24* (2013.01); *B43K 7/12* (2013.01); *B43K 23/126* (2013.01); *B43K 24/06* (2013.01)

USPC ..... 401/116; 401/99

(58) Field of Classification Search

CPC ..... B43K 24/06; B43K 8/24; B43K 7/12; B43K 23/126

USPC ..... 401/116, 68, 75, 88, 92

See application file for complete search history.

(56) References Cited

U.S. PATENT DOCUMENTS

| | | | | |
|---|---|---|---|---|
| 4,511,273 | A * | 4/1985 | Trotta | 401/260 |
| 4,844,640 | A * | 7/1989 | Ganz | 401/116 |
| 7,452,149 | B2 * | 11/2008 | Saito | 401/116 |
| 2003/0129014 | A1 * | 7/2003 | Bauer et al. | 401/192 |

* cited by examiner

*Primary Examiner* — David Walczak
*Assistant Examiner* — Jennifer C Chiang
(74) *Attorney, Agent, or Firm* — Taft Stettinius & Hollister LLP; Daniel J. Krieger

(57) ABSTRACT

A retractable pen includes a cartridge partially received in a recess of a cap such that a first end of the cartridge is fixedly attached to the cap. An elongate barrel includes first and second open ends and a through channel fluidly interconnecting the first and second open ends. A portion of the barrel is snugly and threadedly received in the recess such that the cartridge is received in and extends through the through channel, and the barrel and the cap are rotatingly movable relative to each other via the threaded engagement between an extended position in which the second end of the cartridge extends through and out of the second open end of the barrel, and a retracted position in which the second end of the cartridge is disposed within the barrel.

18 Claims, 9 Drawing Sheets

FIG. 11
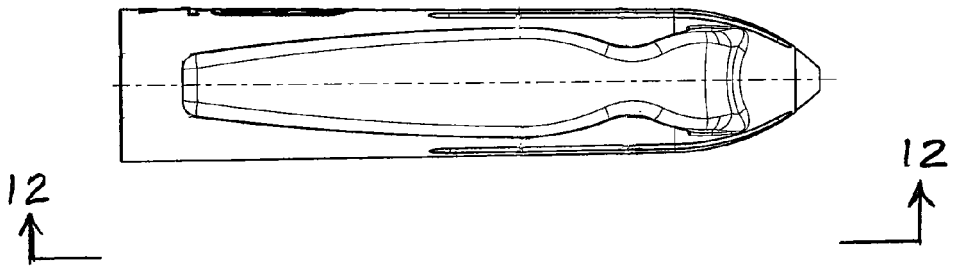
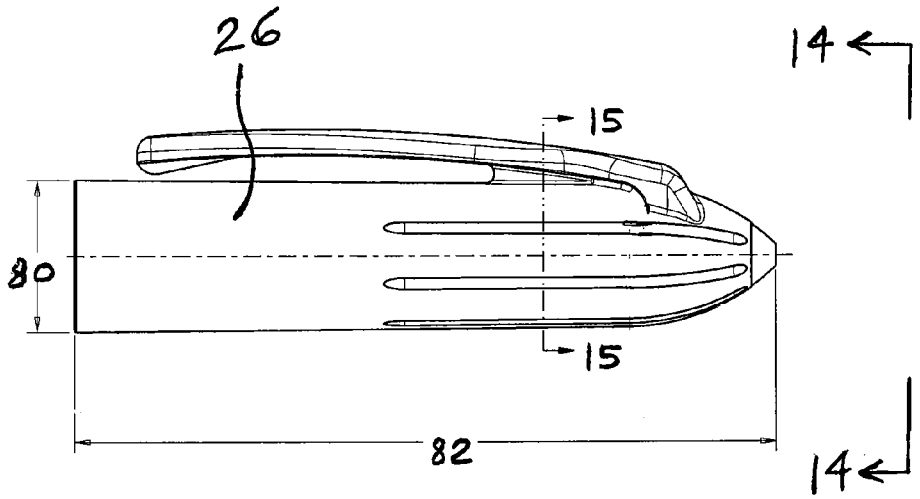
FIG. 12

FIG. 13
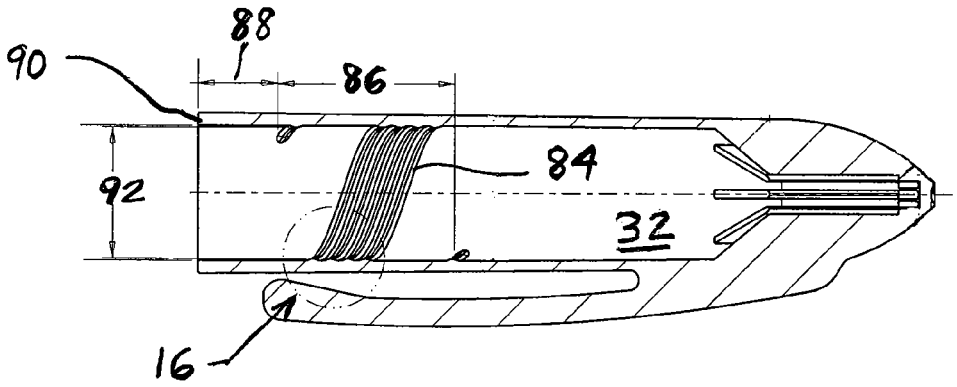
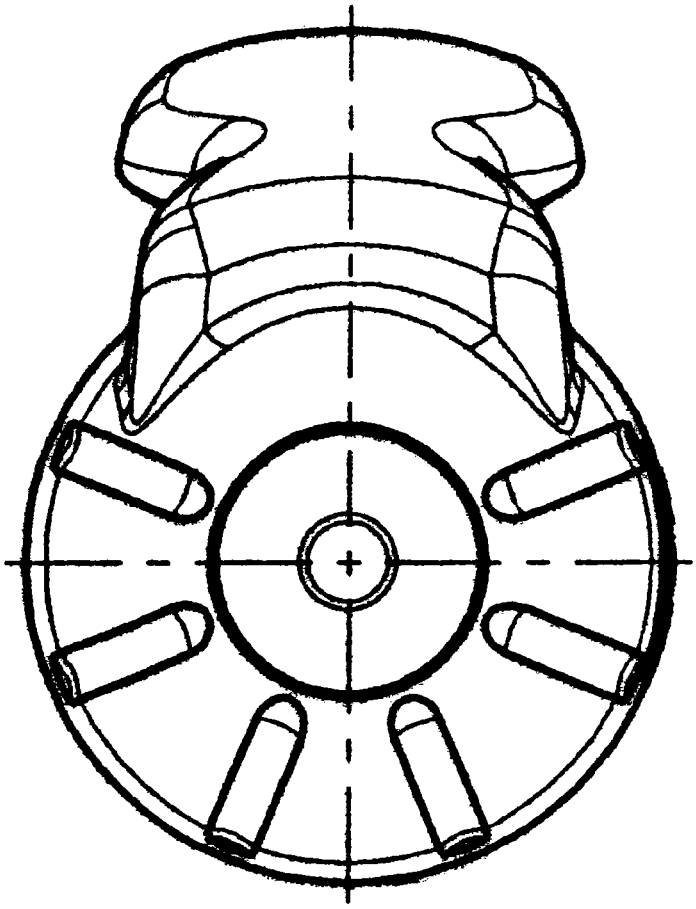
FIG. 14

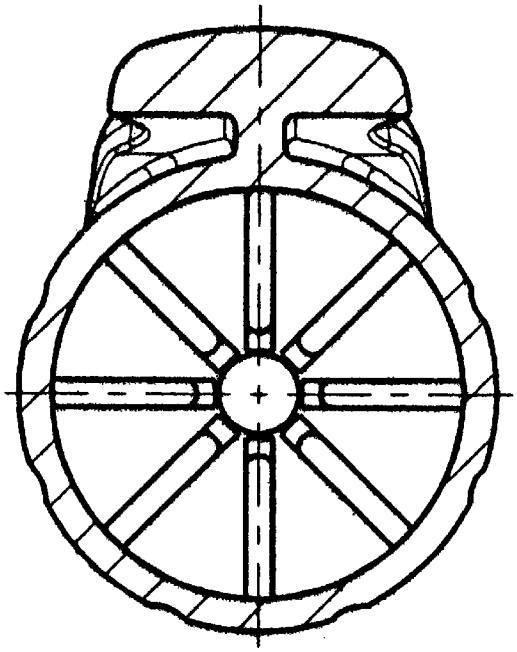
FIG. 15
FIG. 16
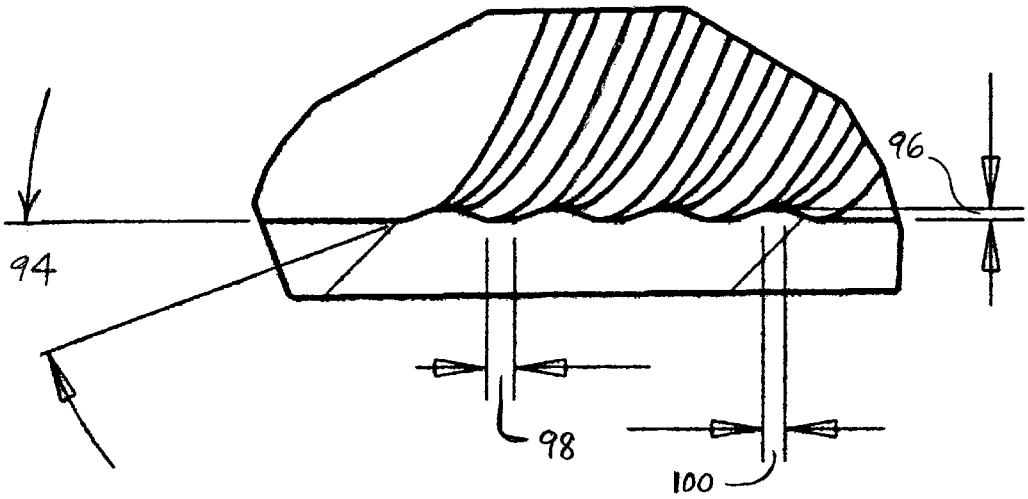

TWO PIECE TWIST ACTION RETRACTABLE WRITING INSTRUMENT

SUMMARY

The present invention provides a retractable writing instrument with a twisting mechanism for retracting an ink cartridge which is incorporated into cap and barrel components. Cartridge retraction/extension mechanism features are integral to the barrel and cap, so no additional components are required.

The invention comprises, in one form thereof; a retractable pen including an elongate cartridge having a first end and a second end. A cap includes a recess having an inner surface with first threads thereon. The cartridge is partially received in the recess such that the first end of the cartridge is fixedly attached to the cap. An elongate barrel includes first and second open ends and a through channel fluidly interconnecting the first and second open ends. A portion of the barrel has an outer surface with second threads thereon. The portion of the barrel including the first open end is snugly received in the recess such that the first and second threads are in threaded engagement with each other, the cartridge is received in and extends through the through channel, and the barrel and the cap are rotatingly movable relative to each other via the threaded engagement between an extended position in which the second end of the cartridge extends through and out of the second open end of the barrel, and a retracted position in which the second end of the cartridge is disposed within the barrel.

The invention comprises, in another form thereof, a retractable pen including an elongate ink cartridge having a first end and a second end. A cap includes a recess having an inner surface with first threads thereon. The cartridge is partially received in the recess such that the first end of the cartridge is fixedly attached to the cap. An elongate barrel includes first and second open ends and a through channel fluidly interconnecting the first and second open ends. A portion of the barrel has an outer surface with second threads thereon. The portion of the barrel including the first open end is snugly received in the recess such that the first and second threads are in threaded engagement with each other, the cartridge is received in and extends through the through channel, and the barrel and the cap are rotatingly movable relative to each other via the threaded engagement between an extended position in which the second end of the cartridge extends beyond the second open end of the barrel, and a retracted position in which the second end of the cartridge is disposed within the barrel. A first ring is attached to the barrel and engages the first threads on the cap in the retracted position. A second ring is attached to the barrel and engages the first threads on the cap in the extended position.

The invention comprises, in yet another form thereof, a retractable pen including an elongate ink cartridge having a first end and a second end. A cap includes a recess having an inner surface with first threads thereon. The cartridge is partially received in the recess such that the first end of the cartridge is fixedly attached to the cap. An elongate barrel includes first and second open ends and a through channel fluidly interconnecting the first and second open ends. A portion of the barrel has an outer surface with second threads thereon. The portion of the barrel including the first open end is snugly received in the recess such that the first and second threads are in threaded engagement with each other, the cartridge is received in and extends through the through channel, and the barrel and the cap are rotatingly movable relative to each other via the threaded engagement between an extended position in which the second end of the cartridge extends beyond the second open end of the barrel, and a retracted position in which the second end of the cartridge is disposed within the barrel. Means prevents the cap from being removed from the barrel.

An advantage of the present invention is that the two-piece construction provides inexpensive component costs and assembly methods.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 11 is a view of the cap along line 11-11 of FIG. 3;

FIG. 12 is a view of the cap along line 12-12 of FIG. 11;

FIG. 13 is a cross-sectional view of the cap along line 13-13 of FIG. 11;

FIG. 14 is an end view of the cap along line 14-14 of FIG. 12;

FIG. 15 is a cross-sectional view of the cap along line 15-15 of FIG. 12; and FIG. 16 is an enlarged view of area 16 in FIG. 13.

Figure 1:
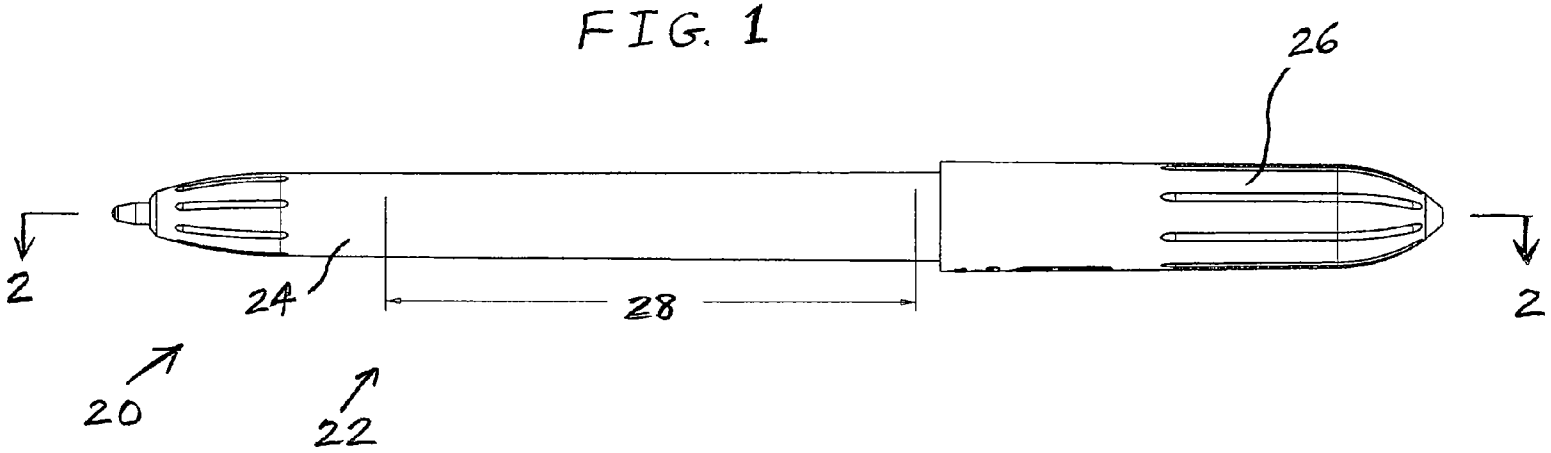
FIG. 1 is a side view of one embodiment of a pen of the present invention in an extended position.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Referring to the drawings, wherein like numerals indicate like elements, FIG. 1 shows one embodiment of a pen 20 of the present invention. Pen 20 includes a two-piece body 22, having a barrel 24 and a cap 26 which is threadedly coupled to barrel 24. Barrel 24 includes a smooth, continuous and annular imprint area 28 on which logos and/or lettering may be printed. However, it is also possible for the portion of barrel 24 including imprint area 28 to have a polygonal cross section. For example, the portion of barrel 24 including imprint area 28 may have a triangular cross section, thereby providing a flat imprint area on which logos and/or lettering may be printed.

Figure 2:
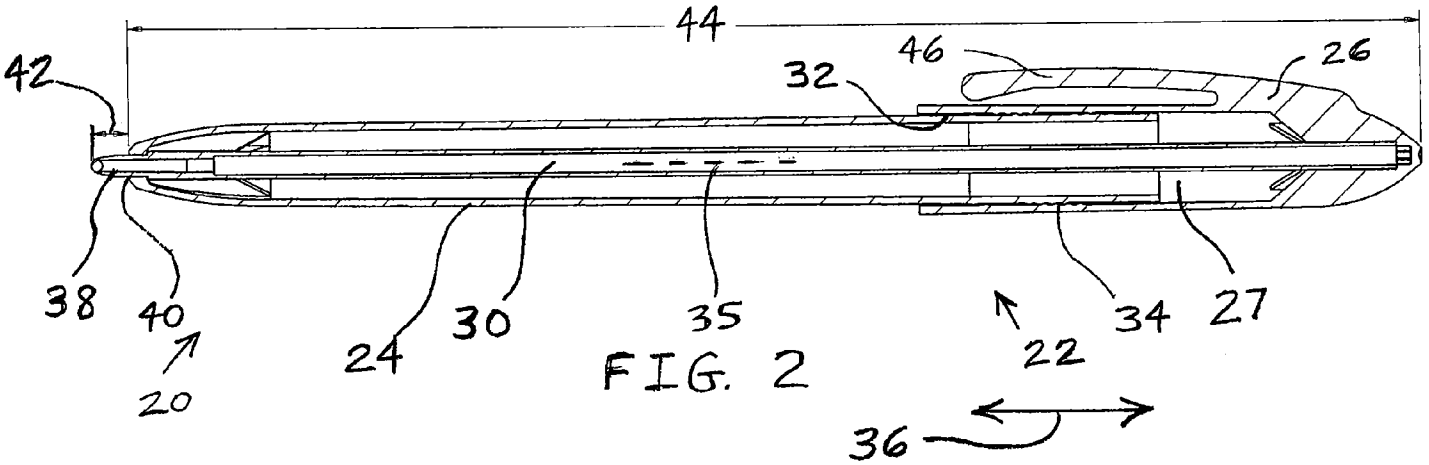
FIG. 2 is a side cross-sectional view of the pen of FIG. 1 taken along line 2-2.

FIG. 2 illustrates a cross-sectional view of pen 20 along line 2-2. An ink cartridge 30 is held firmly in, and is fixedly attached to, cap 26. The cap 26 defines an interior space or recess 27, located inside the cap 26. An interior surface 32 of cap 26 is threaded, and an exterior surface 34 of barrel 24 is correspondingly threaded and received in the recess 27 such that the threads of the interior surface 32 and the threads of the exterior surface 34 are in threaded engagement with each other. The threads on both surfaces 32, 34 may be male. That is, the threads may extend radially outward from surfaces 32, 34. The mating threads on surfaces 32, 34 enable barrel 24 to be screwed inside cap 26. More particularly, barrel 24 and cap 26 may be rotated relative to each other about an imaginary longitudinal axis 35 that is approximately defined by cartridge 30. As barrel 24 is screwed in and out of cap 26 in directions indicated by double arrow 36, pen 20 is moved between an extended position shown in FIGS. 1 and 2 and a retracted position shown in FIGS. 3 and 4. In the extended position, a tip 38 of ink cartridge 30 projects through a through hole 40 in the distal end of barrel 24. Through hole 40 may have a diameter about 1 millimeter larger than the diameter of the portion of cartridge 30 that extends through through hole 40. Thus, cartridge 30 may move freely through through hole 40, but the lateral movement or sway of cartridge 30 may be effectively limited by through hole 40. A distance 42 that tip 38 extends beyond barrel 24 may be approximately between 0.10 and 0.16 inch in one embodiment. A length 44 between the distal tip of barrel 24 and a distal end of cap 26 in the extended position of FIGS. 1 and 2 may be approximately between 5.38 and 5.58 inch in one embodiment. Cap 26 may include a conventional clip 46.

Figure 3:
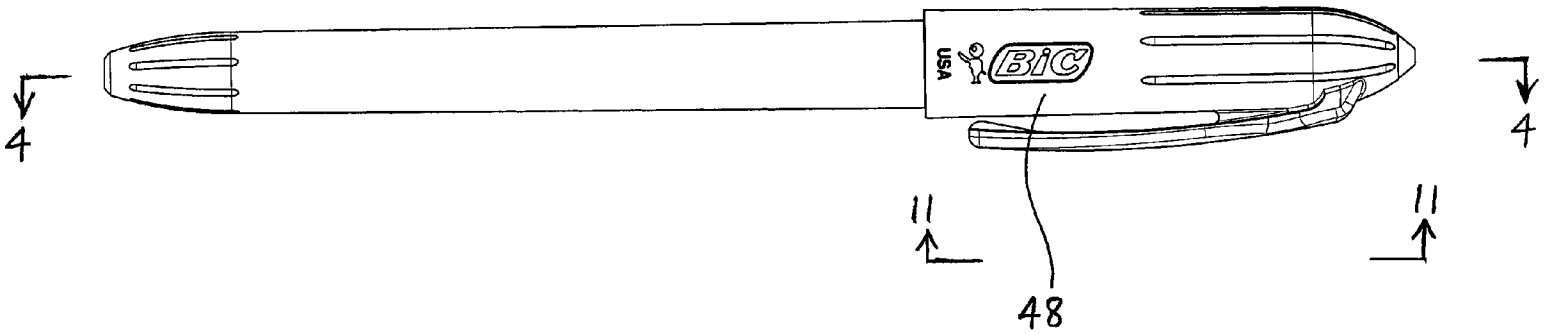
FIG. 3 is a side view of the pen of FIG. 1 in a retracted position.
Figure 4:
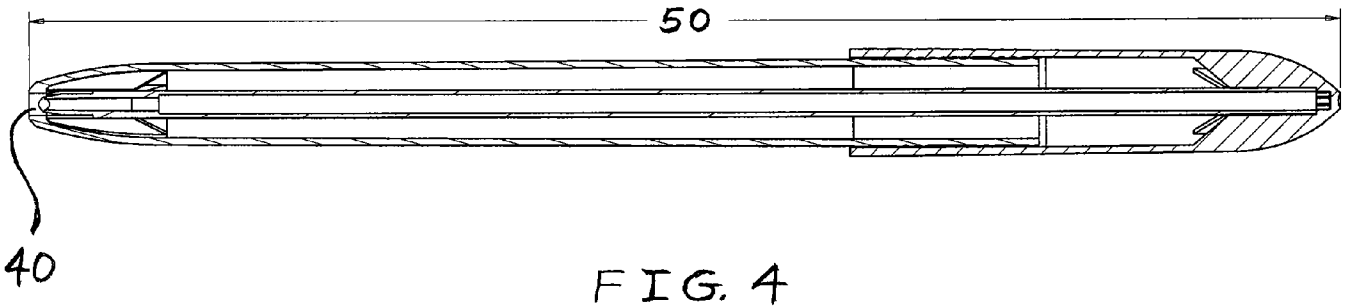
FIG. 4 is a side cross-sectional view of the pen of FIG. 3 taken along line 4-4.

As shown in FIG. 3, cap 26 includes a smooth, continuous and annular imprint area 48 on which logos and/or lettering may be printed. However, it is also possible for the portion of cap 26 including imprint area 48 to have a polygonal cross section. For example, the portion of cap 26 including imprint area 48 may have a triangular cross section, thereby providing a flat imprint area on which logos and/or lettering may be printed. A length 50 (FIG. 4) between the distal tip of barrel 24 and a distal end of cap 26 in the retracted position of FIGS. 3 and 4 may be approximately between 5.52 and 5.72 inch in one embodiment.

Figure 5:
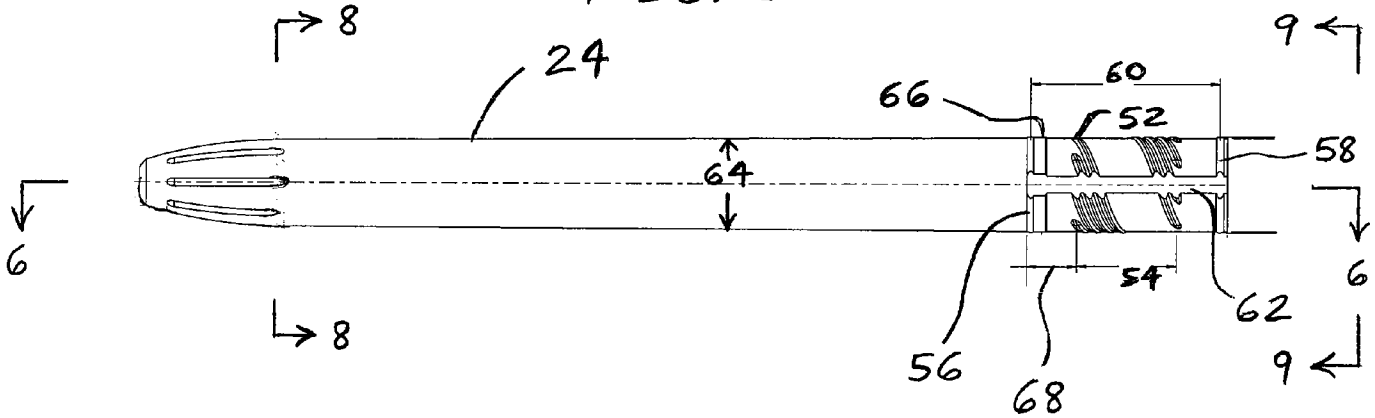
FIG. 5 is a side view of the barrel of the pen of FIG. 1.

As shown in FIG. 5, barrel 24 may include threads in the form of, for example, four leads 52, each of which extends about 360 degrees around barrel 24 over a length 54 of about 0.4 inch. Two rings 56, 58 are disposed on opposite sides of leads 52. In one embodiment, rings 56, 58 are separated by a distance 60 of about 0.76 inch. Rings 56, 58 include are attached to each other by two opposing flats or a bars 62 which hold rings 56, 58 in fixed position relative to each other and which are in diametrically opposed positions on barrel 24. A diameter 64 of barrel 24 may be about 0.376 inch, and a diameter of each of rings 56, 58 may be about 0.386 inch. Attached to and adjacent to ring 56 is an annular shoulder 66 having an intermediate diameter between the diameter of barrel 24 and the diameter of rings 56, 58. For example, the diameter of should 66 may be about 0.380 inch. A distance 68 between ring 56 and an end of leads 52 may be about 0.200 inch.

Figure 6:
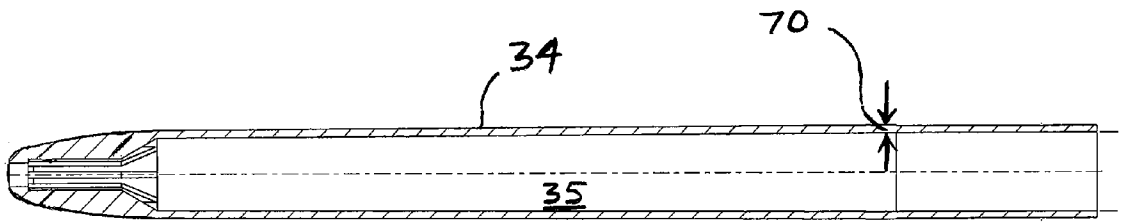
FIG. 6 is a front cross-sectional view of the barrel of FIG. 5 along line 6-6.
Figure 7:
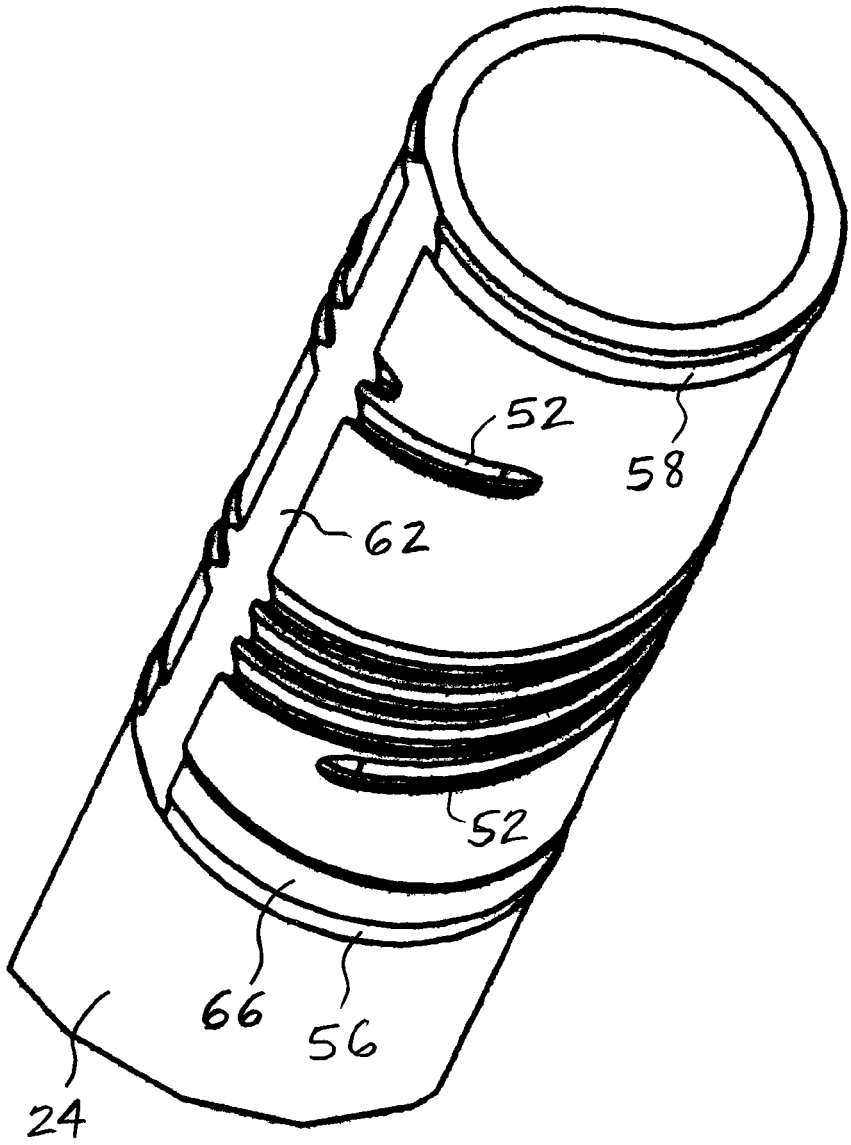
FIG. 7 is a fragmentary perspective view of the rear end of the barrel of FIG. 5.
Figure 9:
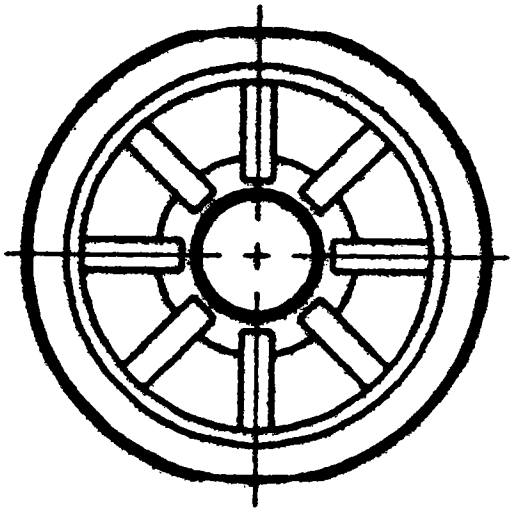
FIG. 9 is a rear view of the barrel of FIG. 5 along line 9-9.
Figure 8:
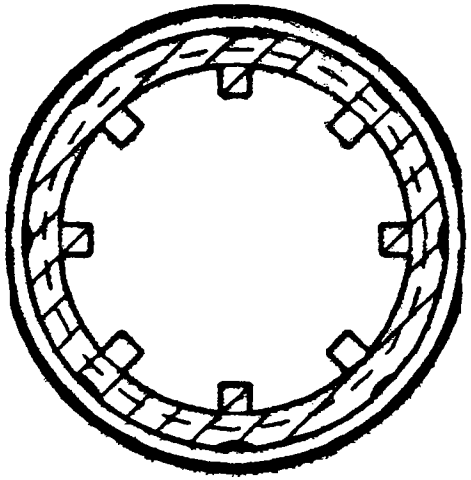
FIG. 8 is a cross-sectional view of the barrel of FIG. 5 along line 8-8.

A wall thickness 70 (FIG. 6) of barrel 24 may be about 0.030 inch. As best shown in FIG. 6, barrel 24 includes a through channel 35 between two opposite open ends. Cartridge 30 may extend through through channel 35, and, in the extended position, may extend through both of the two opposite open ends of barrel 24.

Figure 10:
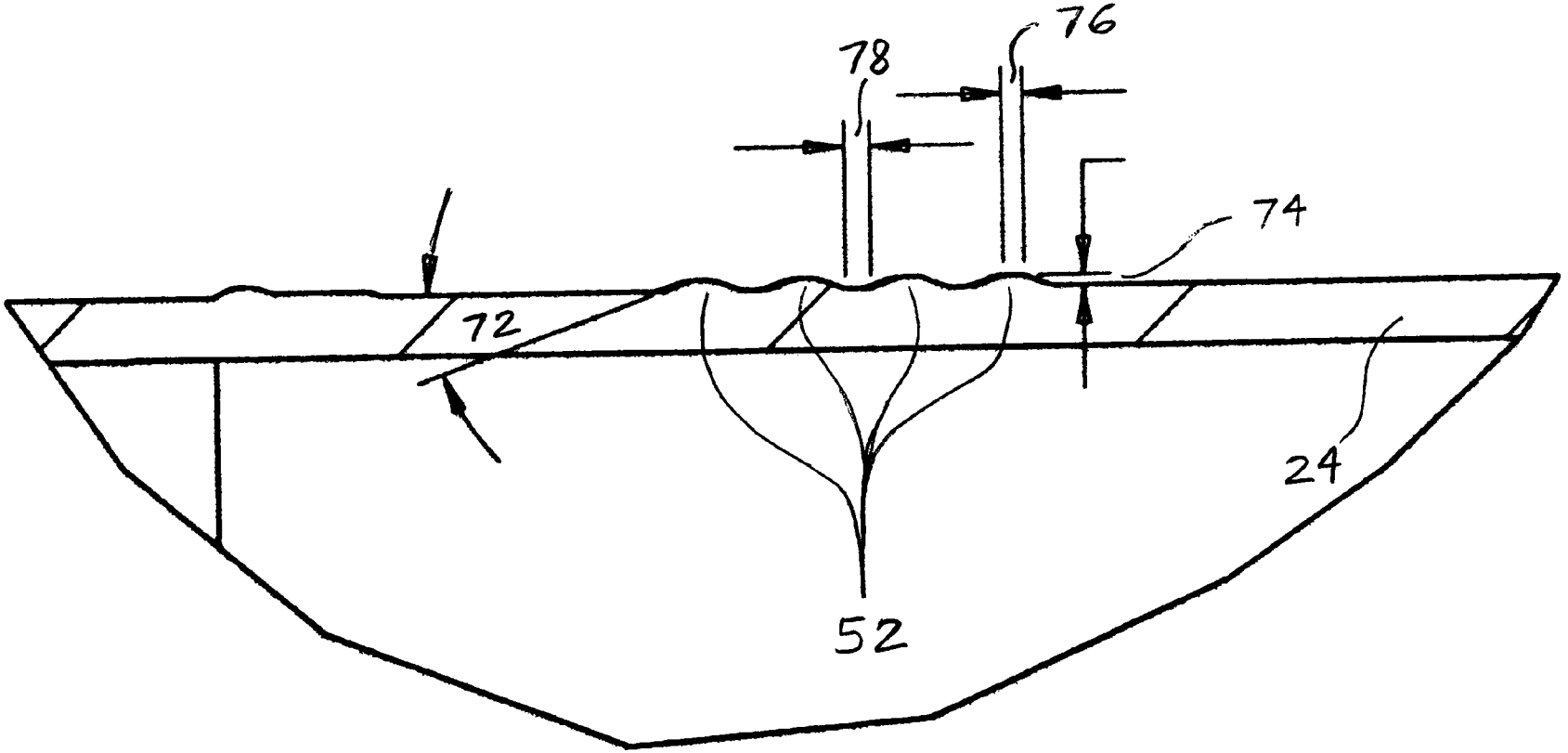
FIG. 10 is a fragmentary cross-sectional view of the threads of the barrel of FIG. 6.

An enlarged cross-sectional view of leads 52 is shown in FIG. 10. An angle of slope 72 of leads 52 may be about 20 degrees. A height 74 of leads 52 may be about 0.005 inch. A width 76 of leads 52 may be about 0.010 inch. A distance 78 between leads 52 may be about 0.013 inch.

As shown in FIG. 12, a width 80 of cap 26 may be about 0.465 inch. A length 82 of cap 26 may be about 2.125 inch. As shown in FIG. 13, annular interior surface 32 of cap 26 may include threads in the form of, for example, four leads 84, each of which extends about 360 degrees around annular interior surface 32. The combination of four leads 84 spans a length 86 of about 0.510 inch. A pitch of leads 84 may be about 0.4 inch, just as with leads 52. A distance 88 between an open end 90 of cap 26 and an end of leads 84 may be about 0.230 inch. An inner diameter 92 of cap 26 may be about 0.390 inch.

An enlarged cross-sectional view of leads 84 is shown in FIG. 16. An angle of slope 94 of leads 84 may be about 20 degrees. A height 96 of leads 84 may be about 0.005 inch. A width 98 of leads 84 may be about 0.013 inch. A distance 100 between leads 84 may be about 0.010 inch.

During assembly, barrel 24 and cap 26 may be pushed together without the need for rotation or axial alignment. During use, ring 58 may abut against or engage one end of leads 84 of cap 26 in the extreme retracted position of pen 20 to thereby prevent cap 26 from separating from barrel 24. Similarly, shoulder 66 and ring 56 may abut against or engage the other end of leads 84 of cap 26 in the extreme extended position of pen 20 to thereby prevent cartridge 30 from extending too far out from barrel 24.

In one embodiment, a distance of travel of cap 26 and cartridge 30 relative to barrel 24 between the retracted and extended positions may be about 0.133 inch. This travel distance of 0.133 inch may correspond to a rotation of about 120 degrees, or one-third of a rotation, of cap 26 relative to barrel 24, assuming a 0.4 inch pitch of the threads per rotation.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A retractable pen, comprising:

an elongate cartridge including a first end and a second end;

a cap defining a first longitudinal axis and having a recess with an inner surface with first threads thereon, wherein the first threads are inclined with respect to the longitudinal axis, the cartridge being partially received in the recess such that the first end of the cartridge is fixedly attached to the cap; and an elongate barrel defining a second longitudinal axis and including first and second open ends and a through channel fluidly interconnecting the first and second open ends, a portion of the barrel having an outer surface with second threads thereon, wherein the second threads are inclined with respect to the second longitudinal axis, the portion of the barrel including the first open end being snugly received in the recess such that the first and second threads are in threaded engagement with each other and the first and second longitudinal axis are aligned with respect to one another, the cartridge is received in and extends through the through channel, and the barrel and the cap are rotatingly movable relative to each other and laterally adjustable relative to each along the aligned first and second longitudinal axis in response to the relative rotation of the barrel and the cap and via the threaded engagement between:

an extended position in which the second end of the cartridge extends through and out of the second open end of the barrel; and a retracted position in which the second end of the cartridge is disposed within the barrel.

2. A retractable pen, comprising;

an elongate cartridge including a first end and a second end;

a cap having a recess with an inner surface with first threads thereon, the cartridge being partially received in the recess such that the first end of the cartridge is fixedly attached to the cap; and an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends through and out of the second open end of the barrel;

a retracted position in which the second end of the cartridge is disposed within the barrel; and a ring attached to the barrel adjacent to the first open end.

3. The pen of claim 2 wherein said ring is configured to engage the first threads on the cap and thereby prevent the cap from being removed from the barrel.

4. The pen of claim 2 wherein said ring is configured to engage the first threads on the cap and thereby prevent the cartridge from being extended more than a predetermined distance out of the second open end of the barrel.

5. The pen of claim 2 wherein each of the first and second threads has a pitch of about 0.4 inch.

6. The pen of claim 2 wherein the cap includes a clip.

7. A retractable pen, comprising:

an elongate cartridge including a first end and a second end;

a cap having a recess with an inner surface with first threads thereon, the cartridge being partially received in the recess such that the first end of the cartridge is fixedly attached to the cap; and an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends through and out of the second open end of the barrel;

a retracted position in which the second end of the cartridge is disposed within the barrel, wherein each of the first and second threads are male.

8. A retractable pen, comprising:

an elongate ink cartridge including a first end and a second end;

a cap having a recess with an inner surface with first threads thereon, the cartridge being partially received in the recess such that the first end of the cartridge is fixedly attached to the cap;

an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends beyond the second open end of the barrel; and a retracted position in which the second end of the cartridge is disposed within the barrel;

a first ring attached to the barrel and configured to engage the first threads on the cap in the retracted position; and a second ring attached to the barrel and configured to engage the first threads on the cap in the extended position.

9. The pen of claim 8 wherein said first ring is configured to prevent the cap from being removed from the barrel.

10. The pen of claim 8 wherein the second ring is configured to prevent the cartridge from being extended more than a predetermined distance out of the second open end of the barrel.

11. The pen of claim 8 wherein each of the first and second threads are male.

12. The pen of claim 8 wherein each of the first and second threads has a pitch of about 0.4 inch.

13. The pen of claim 8 wherein the cap includes a clip.

14. A retractable pen, comprising:

an elongate ink cartridge including a first end and a second end;

a cap having a recess with an inner surface with first threads thereon, the cartridge being partially received in the recess such that the first end of the cartridge is fixedly attached to the cap;

an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends beyond the second open end of the barrel; and a retracted position in which the second end of the cartridge is disposed within the barrel;

means for preventing the cap from being removed from the barrel; and means for preventing the cartridge from being extended more than a predetermined distance out of the second open end of the barrel, wherein the means for preventing the cartridge from being extended more than a predetermined distance out of the second open end of the barrel comprises a ring attached to the barrel and configured to engage the first threads on the cap.

15. The pen of claim 14 wherein each of the first and second threads has a pitch of about 0.4 inch.

16. The pen of claim 14 wherein the cap includes a clip.

17. A retractable pen, comprising:

an elongate ink cartridge including a first end and a second end;

a cap having a recess with an inner surface with first threads thereon, the cartridge being partially received in the recess such that the first end of the cartridge is fixedly attached to the cap;

an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends beyond the second open end of the barrel; and a retracted position in which the second end of the cartridge is disposed within the barrel; and means for preventing the cap from being removed from the barrel, wherein each of the first and second threads are male.

18. A retractable pen, comprising:

an elongate ink cartridge including a first end and a second end;

a cap having a recess with an inner surface with first threads thereon, the cartridge being partially received in the recess such that the first end of the cartridge is fixedly attached to the cap;

an elongate barrel including first and second open ends and a through channel fluidly interconnecting the first and second open ends, a portion of the barrel having an outer surface with second threads thereon, the portion of the barrel including the first open end being snugly received in the recess such that the first and second threads are in threaded engagement with each other, the cartridge is received in and extends through the through channel, and the barrel and the cap are rotatingly movable relative to each other via the threaded engagement between:

an extended position in which the second end of the cartridge extends beyond the second open end of the barrel; and a retracted position in which the second end of the cartridge is disposed within the barrel; and means for preventing the cap from being removed from the barrel, wherein the preventing means comprises a ring attached to the barrel and configured to engage the first threads.

* * * * *